US006608520B1

(12) United States Patent
Miyazaki

(10) Patent No.: US 6,608,520 B1
(45) Date of Patent: Aug. 19, 2003

(54) REGULATOR CIRCUIT

(75) Inventor: Takahiro Miyazaki, Hiji-machi (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/178,201

(22) Filed: Jun. 24, 2002

(30) Foreign Application Priority Data

Jun. 25, 2001 (JP) ..... 2001-191804

(51) Int. Cl.[7] ..... G05F 1/10
(52) U.S. Cl. ..... 327/540
(58) Field of Search ..... 327/530, 534, 327/540, 541, 544, 545

(56) References Cited

U.S. PATENT DOCUMENTS 5,714,905 A * 2/1998 Galli et al. ..... 327/538
6,225,857 B1 * 5/2001 Brokaw ..... 327/540

* cited by examiner

*Primary Examiner*—Jeffrey Zweizig
(74) *Attorney, Agent, or Firm*—W. Daniel Swayze, Jr.; W. James Brady; Frederick J. Telecky, Jr.

(57) ABSTRACT

To provide a regulator circuit capable of preventing oscillation of output voltage when an overcurrent regulating function is activated voltage across resistor 31 is lower than the voltage of voltage source VR2, output of hysteresis comparator 51 is low-level, n-type MOS transistor 63 is turned off, and capacitor 62 is charged to the voltage level of power supply line Vcc under the normal condition. On the other hand, under an overcurrent condition, hysteresis comparator 51 becomes high-level, n-type MOS transistor 63 is turned on, and the charge in capacitor 62 is discharged. Because differential amplifier circuit 41 selects the signal with a lower voltage out of 2 positive side input signals, negative feedback control is applied to the output voltage in reference to voltage source VR1 under the normal condition, and voltage source 64 under the overcurrent condition. In addition, because the voltage at positive input terminal +2 rises at a fixed rate when moving from the overcurrent condition to the normal condition, sudden changes in the output voltage can be restrained.

6 Claims, 3 Drawing Sheets

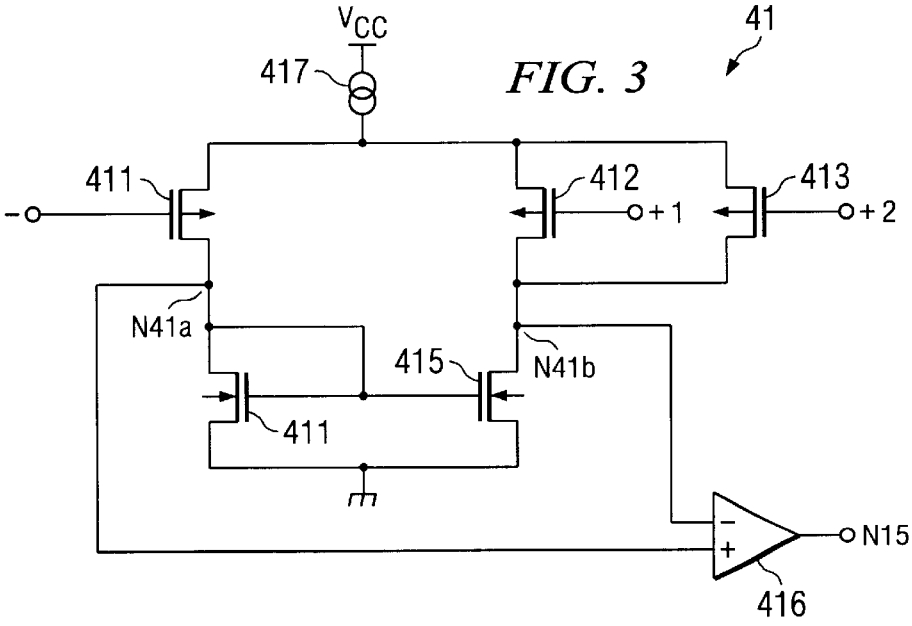
FIG. 3
FIG. 4A
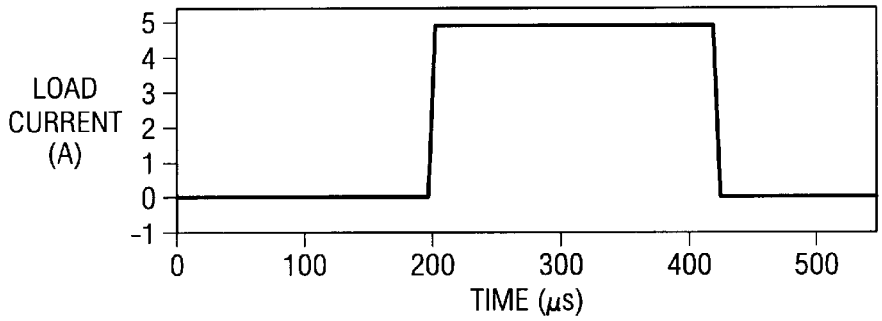
FIG. 4B
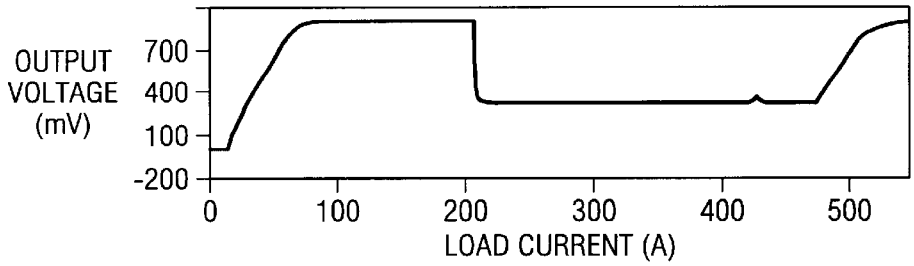

*FIG. 5* *(PRIOR ART)*
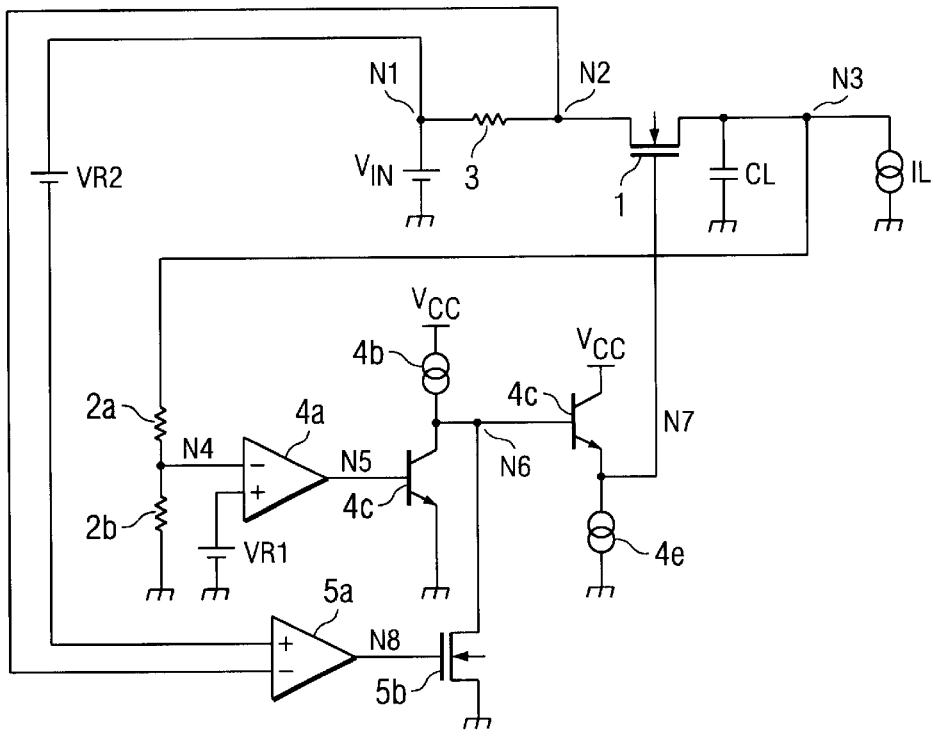
*FIG. 6A* *(PRIOR ART)*
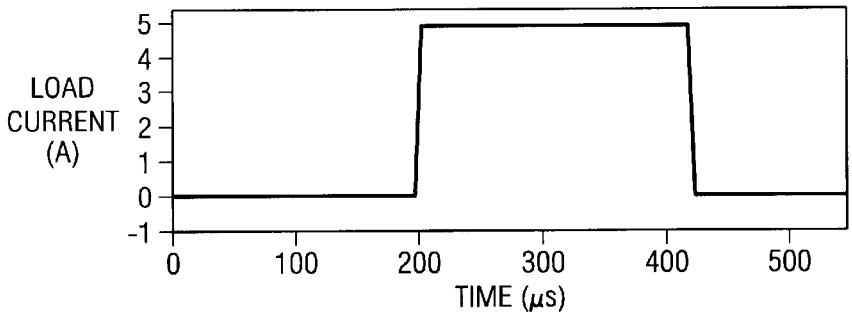
*FIG. 6B* *(PRIOR ART)*
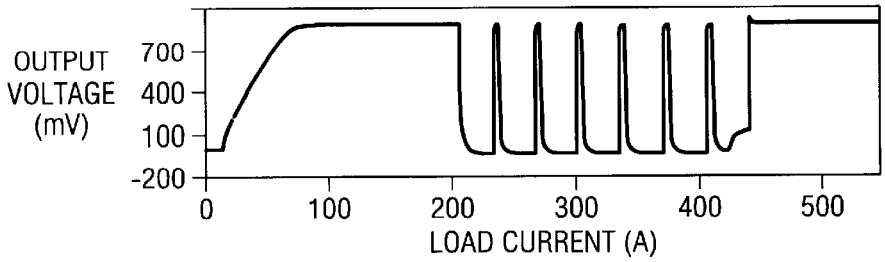

REGULATOR CIRCUIT

FIELD OF THE INVENTION

The present invention pertains to a regulator circuit which regulates an output voltage to a desired voltage. More specifically, it pertains to a regulator circuit that functions to regulate an overcurrent.

BACKGROUND OF THE INVENTION

FIG. 5 is an outlined circuit diagram showing an configuration of a conventional series regulator having an overcurrent regulator circuit.

In the series regulator shown in FIG. 5, negative output terminal of DC voltage source Vin is connected to a ground line, and positive output terminal is connected to terminal N1 of current detection resistor 3. The other terminal N2 of current detection resistor 3 is connected to the drain of n-type MOS transistor 1. Smoothing capacitor CL and current load IL are connected between source N3 of n-type MOS transistor 1 and the ground line.

In addition, resistors 2*a* and 2*b* for voltage detection are connected in series between source N3 of n-type MOS transistor 1 and the ground line, and midpoint N4 between them is connected to positive input terminal + of differential amplifier circuit 4*a*. Negative terminal − of differential amplifier circuit 4*a* is connected to the ground line by way of the positive terminal of voltage source VR1 via its negative terminal. The difference in the voltage between said positive input terminal + and negative input terminal − is amplified by differential amplifier circuit 4*a* and input into base N5 of npn transistor 4*c*.

The emitter of npn transistor 4*c* is connected to the ground line, and the collector is connected to power supply line Vcc via constant-current circuit 4*b* as well as to base N6 of npn transistor 4*d*. The collector of npn transistor 4*d* is connected to power supply line Vcc, and the emitter is connected to the ground line via constant-current circuit 4*e*. Said emitter is also connected to gate N7 of n-type MOS transistor 1.

Terminal N2 of current detection resistor 3 is connected to negative input terminal − of comparator 5*a*. Terminal N1 of current detection resistor 3 is connected to positive input terminal + of comparator 5*a* by way of the positive output terminal of voltage source VR2 via its negative output terminal. A high-level or a low-level voltage in accordance with the result of a comparison of the voltage levels of said positive input terminal + and negative input terminal − is generated by comparator 5*a* and input into the gate of n-type MOS transistor 5*b*. Base N6 of npn transistor 4*d* is connected to the ground line via the drain source terminal of n-type MOS transistor 5*b*.

In the series regulator with the aforementioned configuration, the error between the detected value of the output voltage and its target value is amplified by differential amplifier circuit 4*a* and fed back negatively to the gate of n-type MOS transistor 1 in order to regulate the output voltage supplied to current load IL.

For example, when the voltage at source N3 of n-type MOS transistor 1 increases, the voltage at node N4 where said voltage is divided by resistors 2*a* and 2*b* also increases. Accordingly, output voltage of differential amplifier circuit 4*a* also increases, and collector current of npn transistor 4*c* increases, so that base voltage of npn transistor 4*d* drops. Therefore, emitter voltage of npn transistor 4*d* drops, and gate voltage of n-type MOS transistor 1 drops. As the gate voltage drops, the current between the drain and the source of the n-type MOS transistor is lowered, and the voltage of source N3 drops.

Similarly, when the voltage of source N3 of n-type MOS transistor 1 drops, output voltage of differential amplifier circuit 4*a* drops, base voltage of npn transistor 4*d* increases, and gate voltage of n-type MOS transistor 1 increases, so that the voltage of source N3 also increases.

As described above, negative feedback is applied to the voltage of source N3 of n-type MOS transistor 1 in order for the voltage at node N4 and the voltage of voltage source VR1 to become almost equal.

On the other hand, the circuit comprising current detection resistor 3, voltage source VR2, comparator 5*a*, and n-type MOS transistor 5*b* is a circuit for regulating overcurrent, and it shuts off n-type MOS transistor 1 when the current in current detection transistor 3 has exceeded a fixed level.

When the current in current detection resistor 3 is sufficiently low, and the difference in the potential between terminal N1 and terminal N2 is smaller than the difference in the potential related to voltage source VR2, the voltage of positive input terminal + of comparator 5*a* is lower than that of negative input terminal −. Therefore, the output of comparator 5*a* becomes low-level, and n-type MOS transistor 5*b* is turned off.

When the current in current detection resistor 3 increases, and the difference in the potential between terminal N1 and terminal N2 becomes greater than the potential related to voltage source VR2, the voltage of positive input terminal + of comparator 5*a* becomes higher than that of negative input terminal −, and the output of comparator 5*a* becomes high-level. As a result, n-type MOS transistor 5*b* is turned on, and the base voltage of npn transistor 4*d* drops to that of the ground line. Accordingly, the gate voltage of n-type MOS transistor 1 also drops to that of the ground line, and n-type MOS transistor 1 is turned off.

FIG. 6 is a diagram showing the changes in output voltage when the overcurrent regulating function of the series regulator in FIG. 5 is activated.

FIG. 6A shows an example of a simulated waveform of the current in current load IL, wherein the vertical axis represents load current level, and the horizontal axis represents time. In addition, FIG. 6B shows an example of a simulated waveform of the output voltage supplied to current load IL, wherein the vertical axis represents output voltage level, and the horizontal axis represents time.

As shown by the output voltage waveform in FIG. 6B, when the current in current load IL is increased from 0 A to 5 A to activate the overcurrent regulating function, the series regulator falls into an oscillating condition in which the output voltage vibrates between 0V and 900 mV repeatedly if the output voltage is set at 0.9V.

In other words, if the potential of gate N7 of n-type MOS transistor 1 drops to that of the ground line due to the overcurrent regulating function while under said oscillating condition, n-type MOS transistor is turned off, and the voltage of current detection resistor 3 drops. When the overcurrent regulating function is cancelled as a result, the output voltage starts increasing again, and the output current increases until the overcurrent regulating function is activated. As described above, in the case of the series regulator shown in FIG. 5, the overcurrent regulating function and the normal voltage control are repeated, resulting in the oscillation shown in FIG. 6B.

Once the voltage oscillation shown in FIG. 6B occurs, those circuits supplied with said voltage may start operating abnormally. In addition, a large pulse-like current flows into smoothing condenser CL, resulting in a problem of deteriorated condenser characteristics.

The present invention was formulated in light of said situation, and its objective is to present a regulator circuit capable of preventing output voltage oscillation when the overcurrent regulating function is activated.

SUMMARY OF THE INVENTION

In order to achieve the aforementioned goal, the regulator circuit of the present invention has a voltage output circuit which outputs a voltage in accordance with the level of a voltage control signal input, a voltage detection circuit which outputs a voltage detection signal of the level in accordance with the output voltage of the aforementioned voltage output circuit, a voltage control signal output circuit which selects either a first voltage setting signal input or a second voltage setting signal of a prescribed level according to the levels of the signals and outputs the aforementioned voltage control signal in accordance with the difference in level between said voltage setting signal and the aforementioned voltage detection signal, an overcurrent detection circuit which detects whether the output current level of the aforementioned voltage output circuit is in excess of a prescribed overcurrent level or not, and a voltage setting signal output circuit which sets the level of the aforementioned first voltage setting signal to a first level not selected by the aforementioned voltage control signal output circuit when no overcurrent is detected by the aforementioned overcurrent detection circuit and sets the level of the aforementioned first voltage setting signal to a second level to be selected by the aforementioned voltage control signal output circuit when an overcurrent is detected.

Ideally, when the aforementioned voltage setting signal output circuit changes from the condition in which an overcurrent is detected by the aforementioned overcurrent detection circuit to the condition in which no overcurrent is detected, the aforementioned first voltage setting signal is changed from the aforementioned second level to the aforementioned first level at a prescribed speed.

In addition, ideally, the aforementioned overcurrent level when the aforementioned overcurrent detection circuit changes from the overcurrent condition to the non-overcurrent condition is lower than that when it changes from the non-overcurrent condition to the overcurrent condition.

In addition, the aforementioned voltage control signal output circuit may also have a first transistor which takes the aforementioned voltage detection signal as an input and supplies a voltage signal to a first node, a second transistor which takes the aforementioned first voltage setting signal as an input and supplies a voltage signal to a second node, a third transistor which takes the aforementioned second voltage detection signal as an input and is connected in parallel to the aforementioned second transistor, a current source circuit which supplies current to the aforementioned first transistor and the aforementioned second or third transistor, a current-mirroring circuit which supplies equal current to the aforementioned first node and the aforementioned second node, and an output circuit which outputs the aforementioned voltage control signal in accordance with the difference in voltage between the aforementioned first node and the aforementioned second node.

In addition, the aforementioned voltage setting signal output circuit may also have a constant-current source, a capacitor which is charged by a current supplied from the aforementioned constant-current source, a transistor which becomes conductive to discharge the aforementioned capacitor in accordance with the detection result of the aforementioned overcurrent detection circuit, and a voltage source which applies a prescribed offset to the voltage charged by the aforementioned capacitor to generate the aforementioned first voltage setting signal.

Moreover, the aforementioned voltage output circuit may also be provided with a transistor having a voltage input terminal and a voltage output terminal and supplies an output voltage in accordance with the aforementioned voltage control signal input into its control terminal.

BRIEF DESCRIPTION OF THE DRAWINGS

FIG. 3 is an outline circuit diagram of the input part of differential amplifier circuit 41 with 2 positive input terminals, FIG. 4 is a diagram showing the waveform of the output voltage when the overcurrent regulating function of the regulator circuit shown in FIGS. 2 and 3 is activated, FIG. 5 is an outline circuit diagram of a conventional series regulator having an overcurrent regulator circuit, and FIG. 6 is a diagram showing the changes in output voltage when the overcurrent regulating function of the series regulator in FIG. 5 is activated.

DETAILED DESCRIPTION OF THE INVENTION

First Embodiment

A first embodiment will be explained below in reference to FIG. 1.

Figure 1:
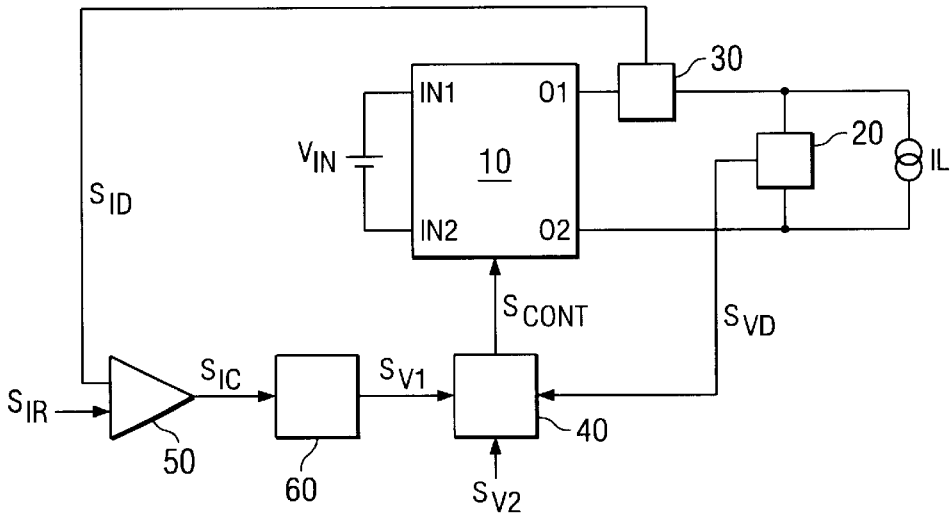
FIG. 1 is an outline block diagram of the regulator circuit.

FIG. 1 is a block diagram showing an configuration of the regulator circuit pertaining to the first embodiment of the present invention. The regulator circuit shown in FIG. 1 has voltage output circuit 10, voltage detection circuit 20, current detection circuit 30, voltage controlling signal output circuit 40, comparator circuit 50, and voltage setting signal output circuit 60.

Voltage output circuit 10 is a circuit which transforms the voltage of voltage source Vin supplied between terminal IN1 and terminal IN2 into a voltage in accordance with voltage control signal Scont and outputs it between terminal O1 and terminal O2. For example, it may be a series regulator type circuit which controls the gate voltage of a transistor connected between terminal IN1 and terminal O1 so as to drop the voltage of voltage source Vin for output. Otherwise, it may also be a DC-DC converter containing a switching element.

Voltage detection circuit 20 is a circuit which outputs voltage detection output signal Svd of a level in accordance with the output voltage of voltage output circuit 10. For example, the output voltage may be detected by dividing the output voltage using an appropriate dividing ratio by means of a dividing circuit utilizing a resistor with a resistance value sufficiently larger than that of the load resistor. In addition, an insulating circuit may be provided, as needed, in order to insulate the output of voltage output circuit 10 from voltage controlling signal output circuit 40 to which voltage detection output signal Svd is input.

Current detection circuit 30 is a circuit which outputs current detection signal Sid of a level in accordance with the output current of voltage output circuit 10. For example, a resistor with a resistance value sufficiently smaller than that of the load resistor may be inserted in the path in which the load current flows in order to detect the output current based on the voltage generated across said resistor. In addition, current detection circuit 30 may be inserted either between the output terminal of voltage output circuit 10 and the voltage detection node of voltage detection circuit 20 as shown in FIG. 1 or between the voltage detection node and the load. In addition, when the input current of voltage output circuit 10 correlates with the output current, current detection circuit 30 may be inserted between the input terminal of voltage output circuit 10 and voltage source Vin.

Voltage controlling signal output circuit 40 selects one voltage setting signal, that is, either voltage setting signal Sv1 output from voltage setting signal output circuit 60 or voltage setting signal Sv2 of a prescribed level, according to their signal levels and outputs voltage control signal Scont in accordance with the difference in level between said voltage setting signal selected and voltage detection signal Svd.

For example, of voltage setting signal Sv1 and voltage setting signal Sv2, the voltage setting signal with a lower voltage level is selected. During normal voltage control, voltage setting signal output circuit 60 to be described later sets the voltage level of voltage setting signal Sv1 higher than that of voltage setting signal Sv2. As a result, voltage controlling signal output circuit 40 selects voltage setting signal Sv2 and outputs voltage control signal Scont in accordance with the voltage difference between voltage setting signal Sv2 and voltage detection signal Svd.

In addition, when the overcurrent regulating function is in operation, voltage setting signal output circuit 60 sets the voltage level of voltage setting signal Sv1 lower than that of voltage setting signal Sv2. As a result, voltage controlling signal output circuit 40 selects voltage setting signal Sv1 and outputs voltage control signal Scont in accordance with the voltage difference between voltage setting signal Sv1 and voltage detection signal Svd.

Comparator 50 compares current detection signal Sid with prescribed overcurrent reference signal Sir in order to judge whether the output current level is in excess of the overcurrent level or not and outputs said judgment result Sic into voltage setting signal output circuit 60.

When judgment result Sic indicating that no overcurrent was detected by comparator 50 is output, voltage setting signal output circuit 60 sets the level of voltage setting signal Sv1 to a first level so that it will not be selected by voltage control signal output circuit 40. In addition, when judgment result Sic indicating that an overcurrent was detected by comparator 50 is output, 30 it sets the level of voltage setting signal Sv1 to a second level so that it will be selected by voltage control signal output circuit 40.

For example, assuming that voltage control signal output circuit 40 selects the voltage setting signal with a lower voltage level in the manner described above, when no overcurrent is detected, the level of voltage setting signal Sv1 is set sufficiently higher than that of voltage setting signal Sv2 in order to avoid selection of voltage setting signal Sv1. In addition, when an overcurrent is detected, the level of voltage setting signal Sv1 is set to a prescribed level which is lower than that of voltage setting signal Sv2 in order to have voltage setting signal Sv1 selected.

Here, operation of the regulator circuit with the aforementioned configuration of FIG. 1 will be explained.

While under the normal voltage control condition where no overcurrent is detected, the level of voltage setting signal Sv1 output from voltage setting signal output circuit 60 is set to the first level so that it will not be selected by voltage control signal output circuit 40. Therefore, voltage control signal Scont is generated by voltage control signal output circuit 40 according to the level difference between voltage setting signal Sv2 and voltage detection signal Svd.

Voltage output circuit 10, voltage detection circuit 20, and voltage control signal output circuit 40 constitute a negative feedback control loop, whereby negative feedback control is applied to voltage control signal Scont so as to reduce the difference in level between voltage setting signal Sv2 and voltage detection signal Svd. As a result, the output voltage of voltage output circuit 10 becomes a voltage in accordance with the level of voltage setting signal Sv2.

Moreover, while under the condition where the overcurrent regulating function is in operation due to an overcurrent detected in the output current, voltage setting signal Sv1 output from voltage setting signal output circuit 60 is set to the second level so that it will be selected by voltage control signal output circuit 40. As a result, negative feedback control is applied to voltage control signal Scont so as to reduce the difference in level between voltage setting signal Sv1 and voltage detection signal Svd, and the output voltage of voltage output circuit 10 becomes a voltage in accordance with the level (second level) of voltage setting signal Sv1.

In the conventional example shown in FIG. 5, when the overcurrent regulating function was activated, gate N7 of n-type MOS transistor 1 dropped to the voltage level of the ground line, and the negative feedback loop was cut off immediately. On the other hand, when the overcurrent regulating function is activated in the regulator circuit shown in FIG. 1, the negative feedback control operates in such a manner that the output voltage becomes a voltage in accordance with the level (second level) of voltage setting signal Sv1. Thus, the output voltage can be made less likely to oscillate as compared to the conventional circuit in which the negative feedback loop is cut off immediately.

Furthermore, the rate at which the level of voltage setting signal Sv1 changes from the second level to the first level when judgment result Sic of comparator circuit 50 changes from the overcurrent condition to the non-overcurrent condition may be controlled arbitrarily by voltage setting signal output circuit 60.

The level of the output voltage can be changed smoothly from the voltage in accordance with voltage setting signal Sv1 to the voltage in accordance with voltage setting signal Sv2 by delaying said rate of change appropriately. As a result, the current flowing into the load capacitor is reduced gradually, and oscillation of the output voltage can be restrained more effectively as compared to the conventional circuit in which the output voltage changes suddenly when the overcurrent condition changes to the non-overcurrent condition.

In addition, comparator circuit 50 may be provided with such a hysteresis characteristic that the overcurrent detection level becomes lower when the overcurrent condition changes to the non-overcurrent condition than when the non-overcurrent condition changes to the overcurrent condition. As a result, judgment result Sic can be prevented from becoming unstable between the non-overcurrent condition and the overcurrent condition due to noise, for example, when the output current level is near the current detection level, so that oscillation of the output voltage can be prevented.

Second Embodiment

Next, a second embodiment of the present invention will be explained in reference to FIGS. 2 through 4. In the second embodiment, the configuration of the aforementioned first embodiment is made more specific.

Figure 2:
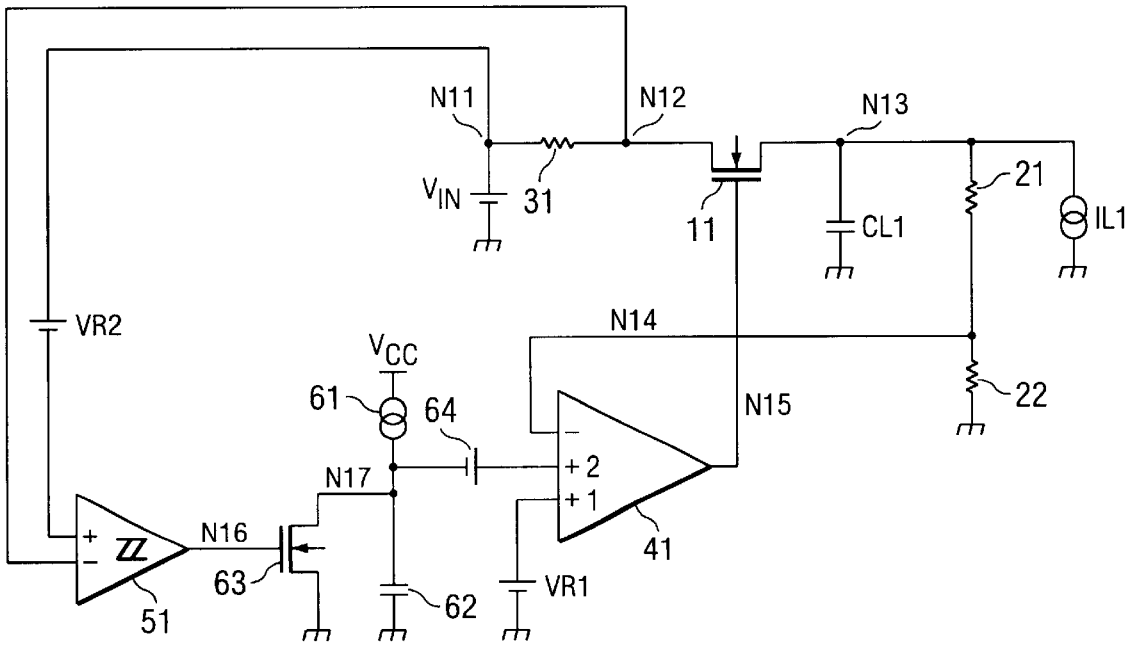
FIG. 2 is another outline circuit diagram of the regulator circuit.

FIG. 2 is an outlined circuit diagram showing an configuration of the regulator circuit pertaining to the second embodiment of the present invention.

In FIG. 2, n-type MOS transistor 11 is a circuit which corresponds to voltage output circuit 10 in FIG. 1.

The circuit comprising resistors 21 and 22 is a circuit which corresponds to voltage detection circuit 20 in FIG. 1.

Resistor 31 is a circuit which corresponds to current detection circuit 30 in FIG. 1.

Differential amplifier circuit 41 is a circuit which corresponds to voltage control signal output circuit 40 in FIG. 1.

Hysteresis comparator 51 is a circuit which corresponds to comparator circuit 50 in FIG. 1.

The circuit comprising constant-current circuit 61, capacitor 62, n-type MOS transistor 63, and constant-voltage source 64 is a circuit which corresponds to voltage setting signal output circuit 60 in FIG. 1.

Negative output terminal of DC voltage source Vin is connected to the ground line, and its positive output terminal is connected to terminal N11 of current detection resistor 31. The other terminal N12 of current detection resistor 31 is connected to the drain of n-type MOS transistor 11. Smoothing capacitor CL1 and current load IL are connected between source N13 of n-type MOS transistor 11 and the ground line.

In addition, resistors 21 and 22 connected in series for voltage detection are connected between source N13 of n-type MOS transistor 11 and the ground line, and midpoint N14 of said connection is connected to negative input terminal − of differential amplifier circuit 41. Differential amplifier circuit 41 has 2 positive input terminals, wherein positive input terminal +1 on one side is connected to the ground line by way of the positive terminal of voltage source VR1 via its negative terminal. Positive input terminal +2 on the other side is connected to the positive terminal of voltage source 64. Output of differential amplifier circuit 41 is connected to gate N15 of n-type MOS transistor 11.

Terminal N12 of current detection resistor 31 is connected to negative input terminal − of hysteresis comparator 51. Terminal N11 of current detection resistor 31 is connected to positive input terminal + of hysteresis comparator 51 by way of the positive terminal of voltage source VR2 via its negative terminal. A high-level or a low-level voltage is generated by hysteresis comparator 51 in accordance with the result of a comparison of the voltage level between said positive input terminal + and negative input terminal − and input into gate N16 of n-type MOS transistor 63. Drain of n-type MOS transistor 63 is connected to power supply line Vcc via constant-current circuit 61 as well as to the source of the n-type MOS transistor and the ground line via capacitor 62. In addition, connection midpoint N17 between constant-current circuit 61 and capacitor 62 is connected to the negative terminal of voltage source 64.

Here, an example of more specific configuration of differential amplifier circuit 41 will be explained.

FIG. 3 is an outlined circuit diagram showing an example configuration of the input part of differential amplifier circuit 41 with 2 positive input terminals.

As shown in FIG. 3, gate of p-type MOS transistor 411 is connected to negative input terminal −, gate of p-type MOS transistor 412 is connected to positive input terminal +1, and gate of p-type MOS transistor 413 is connected to positive input terminal +2.

Sources of p-type MOS transistor 411, p-type MOS transistor 412, and p-type MOS transistor 413 are connected in common, and they are further connected to power supply line Vcc via constant-current circuit 417.

Drain of p-type MOS transistor 411 is connected to the drain of n-type MOS transistor 414, and the drains of p-type MOS transistor 412 and p-type MOS transistor 413 are connected to the drain of n-type MOS transistor 415.

Gates of n-type MOS transistor 414 and n-type MOS transistor 415 are connected in common, and their sources are connected to the ground line. In addition, the gate and the drain of n-type MOS transistor 414 are connected.

Node N41*a* to which the drains of p-type MOS transistor 411 and n-type MOS transistor 414 are connected is connected to positive input terminal + of differential amplifier circuit 416. Node N41*b* to which the drains of p-type MOS transistor 412, p-type MOS transistor 413, and n-type MOS transistor 415 are connected in common is connected to negative input terminal − of differential amplifier circuit 416. Output terminal of differential amplifier circuit 416 is connected to gate N15 of n-type MOS transistor 11.

In differential amplifier circuit 41 with the aforementioned configuration, n-type MOS transistor 414 and n-type MOS transistor 415 constitute a current-mirroring circuit, whereby a current which matches the drain current of n-type MOS transistor 414 flows into the drain of n-type MOS transistor 415.

In addition, either p-type MOS transistor 412 or p-type MOS transistor 413 which are connected in parallel is activated according to the voltage level at positive input terminal +1 and positive input terminal +2. In other words, p-type MOS transistor 412 is activated when the voltage at positive input terminal +1 is lower than that at positive input terminal +2, and p-type MOS transistor 413 is activated when the voltage at positive input terminal +2 is lower than that at positive input terminal +1. The voltage difference between the negative input terminal and the positive input terminal is amplified by the differential amplifier circuit configured with said activated transistor, p-type MOS transistor 411, constant-current circuit 417, and the aforementioned current-mirroring circuit and is output as a differential voltage between node N41*a* and node N41*b*. Said differential voltage is amplified by differential amplifier circuit 416 and input into gate N15 of n-type MOS transistor 11.

Next, operation of the regulator circuit with the aforementioned configuration shown in FIGS. 2 and 3 will be explained.

During the normal voltage control condition where the overcurrent regulating function does not operate, the current flowing in resistor 31 is lower than that under the overcurrent condition, and the voltage generated across said resistor is lower than the voltage of voltage source VR2. In such case, the voltage at negative input terminal− of hysteresis comparator 51 becomes higher than the voltage at positive input terminal +, and the output voltage of hysteresis comparator 51 becomes low-level. Thus, n-type MOS transistor 63 is turned off, and capacitor 62 gets charged to the voltage of power supply line Vcc by the current from constant-current circuit 61.

Because the voltage charged in capacitor 62 rises to the voltage level of power supply line Vcc, the voltage level at positive input terminal +2 of differential amplifier circuit 41 becomes sufficiently higher than that at positive input terminal +1, and p-type MOS transistor 412 is activated. That is, the voltage difference between positive input terminal +1 and negative input terminal− is amplified at differential amplifier circuit 41 and output into the gate of n-type MOS transistor 11.

Therefore, under the normal voltage control condition, negative feedback control is applied to the voltage at node N13 in such a manner that the voltage generated by voltage source VR1 at positive input terminal +1 matches roughly the voltage at node N14.

On the other hand, when the overcurrent regulating function is in operation, the voltage generated across resistor 31 becomes higher than the voltage of voltage source VR2, and the output voltage of hysteresis comparator 51 becomes high-level. Thus, n-type MOS transistor 63 is activated, the charge in capacitor 62 is discharged, and the voltage at node N17 drops to the voltage of the ground line.

At this time, if the voltage of voltage source 64 is set lower than that of voltage source VR1, the voltage level of positive input terminal +2 becomes lower than that of positive input terminal +1, and p-type MOS transistor 413 is activated. That is, the voltage difference between positive input terminal +2 and negative input terminal – is amplified at differential amplifier circuit 41output into the gate of n-type MOS transistor 11.

Therefore, while the overcurrent regulating function is in operation, negative feedback control is applied to the voltage at node N13 in such a manner that the voltage generated by voltage source 64 at positive input terminal +2 matches roughly the voltage at node N14. Because the voltage of voltage source 64 is set lower than that of voltage source VR1, the output voltage while the overcurrent regulating function is in operation becomes lower than that under the normal voltage control condition.

As described above, in the case of the regulator circuit shown in FIGS. 2 and 3, like the regulator circuit in FIG. 1, negative feedback control operates in such a manner that the voltage at node N14 matches the voltage of voltage source 64 when the overcurrent regulating function is activated. Therefore, the output voltage can be made less likely to oscillate as compared to the conventional circuit in which the negative feedback loop is cut off immediately.

In addition, when the voltage across resistor 31 becomes lower than VR2, the operation of the overcurrent regulating function is cancelled, and output of hysteresis comparator 51 changes from high level to low level, and n-type MOS transistor 63 changes its status from on to off accordingly.

At this point, the voltage at node N17 which has dropped to the voltage of the ground line starts increasing gradually as capacitor 62 is charged by the current from constant-current circuit 61, and the voltage at positive input terminal +2 of differential amplifier circuit 41 gradually increases accordingly. Then, when the voltage at positive input terminal +2 exceeds the voltage of positive input terminal +1, n-type MOS transistor 412 is activated again, moving to the normal voltage control condition.

As described above, because the level of the voltage input into positive input terminal +2 is increased gradually at a fixed rate when moving from the condition in which the overcurrent regulating function is in operation to the normal voltage control condition, the voltage at node N13 also changes smoothly accordingly. Therefore, the oscillation of the output voltage can be restrained more effectively as compared to the conventional circuit in which the output voltage changes suddenly. Furthermore, transient current flowing into smoothing capacitor CL1 can also be restrained.

In addition, hysteresis comparator 51 applies different voltages between positive input terminal + and negative input terminal – when the output is changed from low level to high level and when it is changed from high level to low level. Thus, when the voltage difference between positive input terminal + and negative input terminal – falls under the voltage range of a dead zone, the output level does not change due to said voltage difference. That is, overcurrent detection levels are different when moving from the normal condition to the overcurrent condition and when moving from the overcurrent condition to the normal condition, and the overcurrent detection level of the latter case is lower than that of the former.

Thus, if the current flowing into resistor 31 under the overcurrent condition does not become lower than the overcurrent detection level when moving from the normal condition to the overcurrent condition, the overcurrent condition does not change to the normal condition. In contrast, if the current flowing into resistor 31 under the normal condition does not become higher than the overcurrent detection level when moving from the overcurrent condition to the normal condition, the normal condition does not change to the overcurrent condition.

Therefore, even when the voltage difference between positive input terminal + and negative input terminal – changes due to noise while the current in resistor 31 is near the overcurrent detection level, sudden changes between the condition in which the overcurrent regulating function is in operation and the normal condition can be prevented, so that oscillation of the output voltage can be restrained.

FIG. 4 is a diagram showing an example of the waveform of the output voltage when the overcurrent regulating function of the regulator circuit shown in FIGS. 2 and 3 is activated.

FIG. 4A shows an example of a simulated waveform of the current flowing in current load IL, wherein the vertical axis represents load current level, and the horizontal axis represent time. FIG. 4B shows an example of a simulated waveform of the output voltage applied to current load IL, wherein the vertical axis represents output voltage level, and the horizontal axis represent time.

As shown in the output voltage waveform in FIG. 4B, although the output voltage of the regulator circuit drops from around 900 mV to around 300 mV when the overcurrent regulating function is activated as the current in current load IL is increased from 0 A to 5 A, it does not vibrate like the output voltage of the conventional circuit shown in FIG. 6B does. In addition, when the current in current load IL returns to 0 A from 5 A, the output voltage rises smoothly after a delay time of several 10 $\mu$s.

As described above, in the case of the regulator circuit shown in FIGS. 2 and 3, oscillation of the output voltage while the overcurrent regulating function is in operation can be prevented.

The present invention is not limited to the aforementioned embodiments.

For example, the MOS transistors used in FIG. 2 and 3 may be replaced with a bipolar transistors.

In addition, the n-type MOS transistors used in FIGS. 2 and 3 may also be replaced with p-type MOS transistors, and the p-type MOS transistors with n-type MOS transistors.

In addition, various modifications clear to persons skilled in the art can also be made.

With the present invention, oscillation of output voltage when the overcurrent regulating function is activated can be prevented.

What is claimed is:

1. A regulator circuit having a voltage output circuit which outputs a voltage in accordance with the level of a voltage control signal input, comprising:

a voltage detection circuit which outputs a voltage detection signal of the level in accordance with the output voltage of the voltage output circuit, a voltage control signal output circuit which selects either a first voltage setting signal input or a second voltage setting signal of a predetermined level according to the levels of the signals and outputs the voltage control signal in accordance with the difference in level between said voltage setting signal and the voltage detection signal, an overcurrent detection circuit which detects whether the output current level of the voltage output circuit is in excess of a predetermined overcurrent level or not, and a voltage setting signal output circuit which sets the level of the first voltage setting signal to a first level not selected by the voltage control signal output circuit when no overcurrent is detected by the overcurrent detection circuit and sets the level of the first voltage setting signal to a second level to be selected by the voltage control signal output circuit when an overcurrent is detected.

2. The regulator circuit as in claim 1, wherein, when the voltage setting signal output circuit changes from the condition in which an overcurrent is detected by the overcurrent detection circuit to the condition in which no overcurrent is detected, the first voltage setting signal is changed from the second level to the first level at a predetermined speed.

3. The regulator circuit as in claim 1, wherein the overcurrent level when the overcurrent detection circuit changes from the overcurrent condition to the non-overcurrent condition is lower than that when it changes from the non-overcurrent condition to the overcurrent condition.

4. The regulator circuit as in claim 1, wherein the voltage control signal output circuit has a first transistor which takes the voltage detection signal as an input and supplies a voltage signal to a first node, a second transistor which takes the first voltage setting signal as an input and supplies a voltage signal to a second node, a third transistor which takes the second voltage detection signal as an input and is connected in parallel to the second transistor, a current source circuit which supplies current to the first transistor and the second or third transistor, a current-mirroring circuit which supplies equal current to the first node and the second node, and an output circuit which outputs the voltage control signal in accordance with the difference in voltage between the first node and the second node.

5. The regulator circuit as in claim 4, wherein the voltage setting signal output circuit has a constant-current source, a capacitor which is charged by a current supplied from the constant-current source, a transistor which becomes conductive to discharge the capacitor in accordance with the detection result of the overcurrent detection circuit, and a voltage source which applies a predetermined offset to the voltage charged by the capacitor to generate the first voltage setting signal.

6. The regulator circuit as in claim 4, wherein the voltage output circuit is provided with a transistor having a voltage input terminal and a voltage output terminal and supplies an output voltage in accordance with the voltage control signal input into its control terminal.

* * * * *